US006351365B1

(12) United States Patent
Gilcrease

(10) Patent No.: US 6,351,365 B1
(45) Date of Patent: Feb. 26, 2002

(54) ELECTRICAL WIRING DEVICE AND METHOD

(75) Inventor: Ronald W. Gilcrease, Laguna Niguel, CA (US)

(73) Assignee: ABM Industries Incorporated, San Francisco, CA (US)

( * ) Notice: Subject to any disclaimer, the term of this patent is extended or adjusted under 35 U.S.C. 154(b) by 0 days.

(21) Appl. No.: 09/479,331

(22) Filed: Jan. 6, 2000

(51) Int. Cl.[7] ..... H01H 73/00
(52) U.S. Cl. ..... 361/115; 361/58
(58) Field of Search ..... 361/115, 58

(56) References Cited

U.S. PATENT DOCUMENTS 4,109,991 A * 8/1978 Evans ..... 339/99

* cited by examiner

*Primary Examiner*—Stephen W. Jackson
(74) *Attorney, Agent, or Firm*—Flehr Hohbach Test Albritton & Herbert LLP

(57) ABSTRACT

A wiring device for use with a wire having a conductor disposed within insulation. The wiring device includes a housing of an electrical insulating material provided with a recess adapted to receive the wire. A cutting blade is carried by the insulated housing for severing the wire in the recess into first and second wire portions. A first electrical contact is carried by the housing for making electrical contact with the conductor of the first wire portion. A second electrical contact is carried by the housing and electrically connected to the first electrical contact for making electrical contact with the conductor of the second wire portion so that the conductors of the first and second wire portions can be electrically reconnected after being severed by the cutting blade.

21 Claims, 5 Drawing Sheets

ELECTRICAL WIRING DEVICE AND METHOD

FIELD OF THE INVENTION

The present invention relates generally to electrical wiring devices and, in particular, to a device that substantially reduces the hazard associated with servicing a live electrical circuit.

BACKGROUND OF THE INVENTION

Servicing of an electrical appliance is most safely carried out with the electrical power is removed from the appliance. There are, however, circumstances where it is not feasible to turn off the power to the appliance. For example, in large retail stores, lighting fixtures or other electrical fixtures as represented by element 2 of FIG. 1 of the drawings frequently need servicing, such a replacement the ballast of a fluorescent light. However, it is frequently not feasible to shut off the power at the power source 4 (FIG. 1) to permit such servicing. This is usually due to the fact that other electrical fixtures 8 powered by the source 4 need to remain operative.

In such cases, the service person will typically cut the live or hot wire 6 of wire pair 3/6 using insulated pliers at some location 5 adjacent the fixture 2. The service person then carefully places a wire nut over the exposed end of the severed hot wire 6 on the power source 4 side. Once electrical fixture 2 is disconnected from the power source 4, servicing can be carried out. When the servicing has been completed, the service person must electrically reconnect wire by stripping the insulation from both sections of live wire 6 and applying a wire nut to physically and electrically couple to the sections back together.

FIG. 8 is a cross-sectional view of the subject wiring device taken along section line 8—8 of FIG. 6.

DETAILED DESCRIPTION OF THE INVENTION

Figure 1:
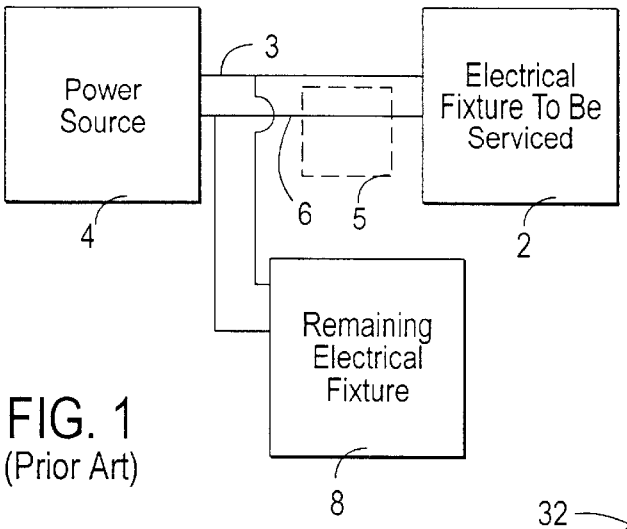
FIG. 1 (Prior Art)
FIG. 1 is a simplified block diagram illustrating a typical prior art electrical wiring environment in which that subject invention may be used.

Referring again to the drawings, FIGS. 2–10 depict various views of the subject wiring device 10. Generally, the wiring device is placed over live wire 6 at location 5 of FIG.

1. The device operates to first sever wire 6 into a live section 6A connected to the power source 4 and a dead section 6B connected to the electrical fixture 2 to be serviced. Upon completion of the servicing of the fixture, the insulation is stripped from the end of the dead section 6B and inserted back into the wire device which functions to electrically and physically reconnect sections 6A and 6B. The wire device, which is relatively small, remains installed on wire 6. This procedure reduces substantially all risks of injury due to electrical shock.

Figure 2:
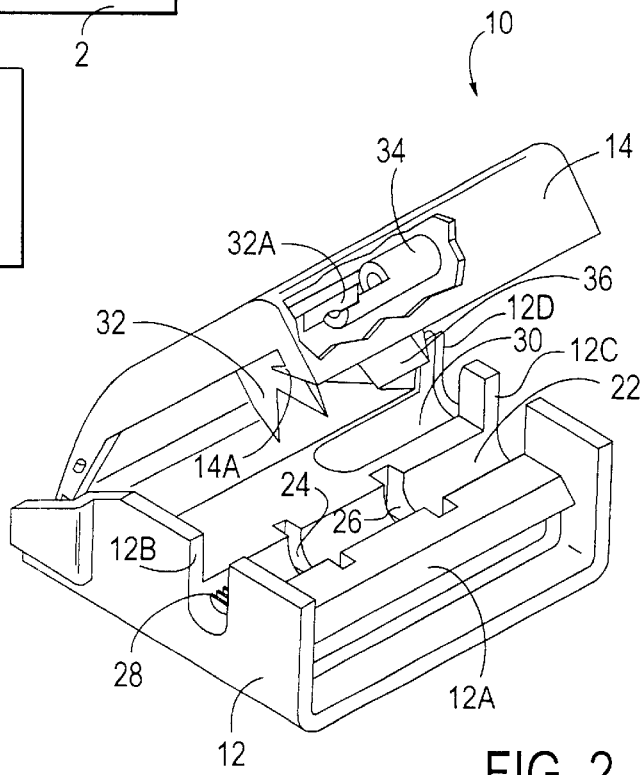
FIG. 2 is from a perspective view of one embodiment of the subject wiring device in the open or unclamped position.
Figure 10:
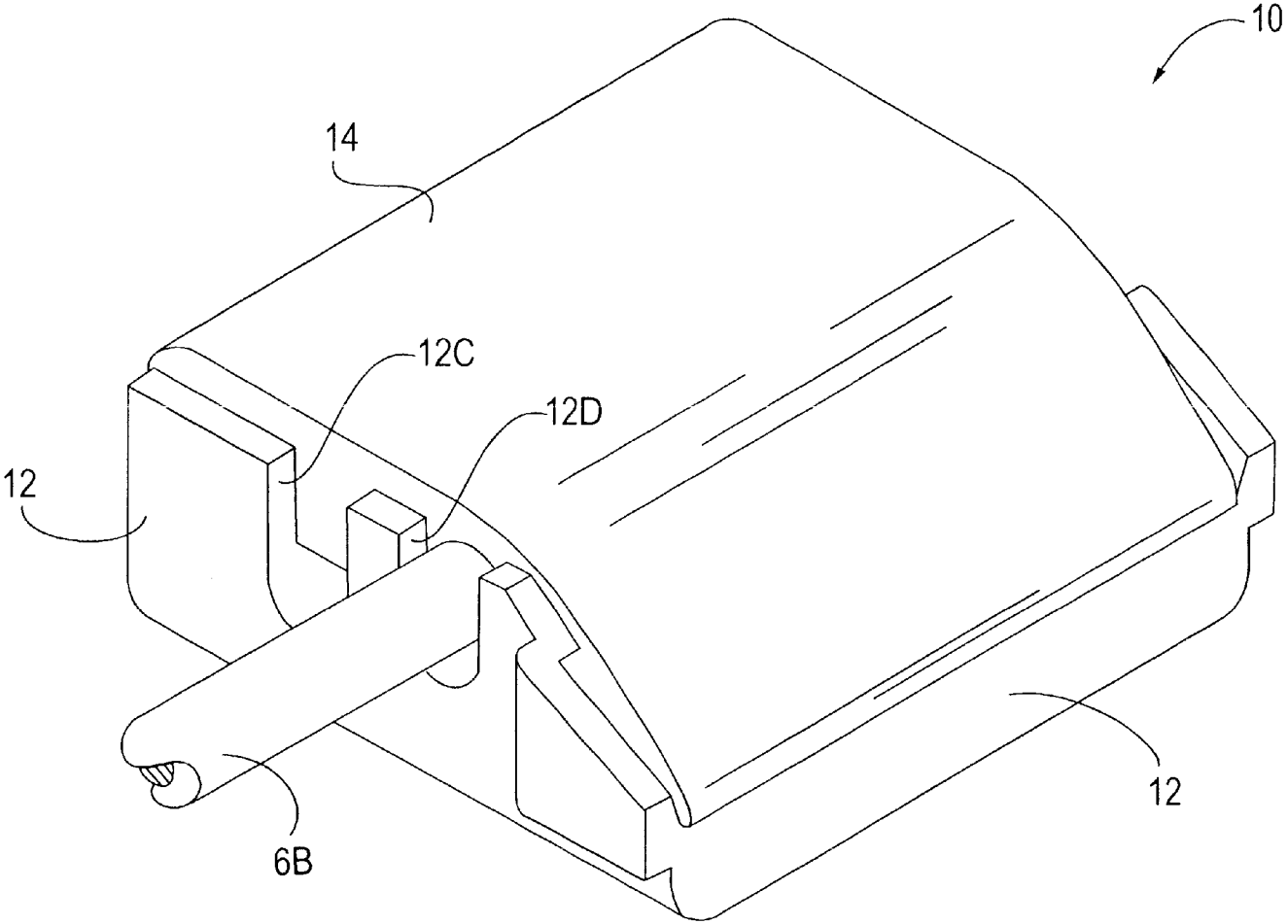
FIG. 10 is a front perspective view of one embodiment of the device in the closed or clamped position.

The wiring device 10 includes an insulated housing having a base member 12 and a cover member 14. A hinge mechanism 18 (FIG. 3) connects the base and cover members together and permits the wiring device to be moved between an open position as shown in FIG. 2, for example, and a closed or clamped position as shown in FIG. 10, for example. A catch member 14A is formed in cover member 14 which engages a cooperating lip member 12A formed in the base member 12 to lock the wiring device in the clamped position.

Figure 6:
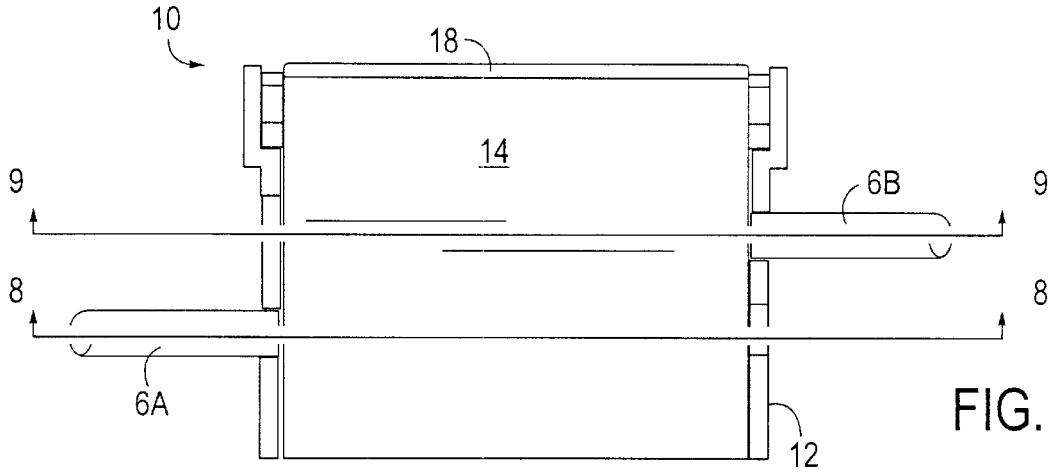
FIG. 6 is a plan view of the subject wiring device.
Figure 7:
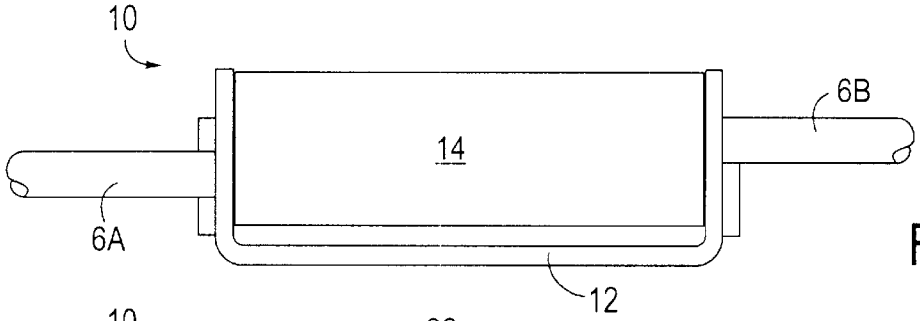
FIG. 7 is a front elevational view of the subject wiring device.

The base member 12 is provided with a wire recess 22 which extends across the full width of the member and which defines a wire receiving path as represented by section line 8—8 of FIG. 6. Wall sections (not designated) are formed in the opposite ends of the base member 12, with one end having a cut-out 12B in the wall section for receiving a wire and the other end having a cut-out 12C for receiving the wire. Teeth 28 (FIG. 2) are formed in base member 12 near cut-out 12B to engage and grip the insulation of a wire located along the wire path when the device 10 is in the closed position.

Figure 4:
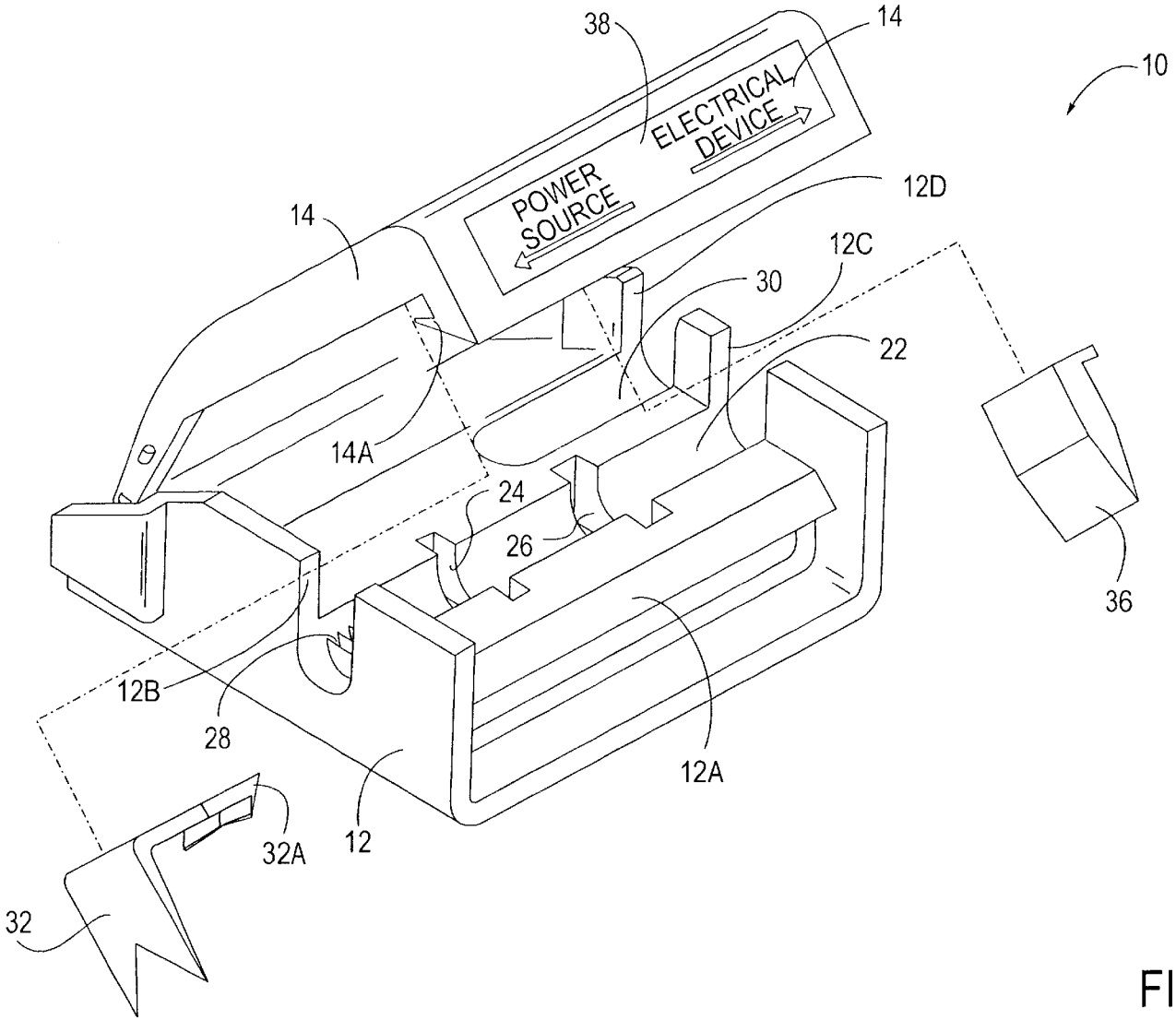
FIG. 4 is an exploded perspective view of the wiring device.
Figure 8:
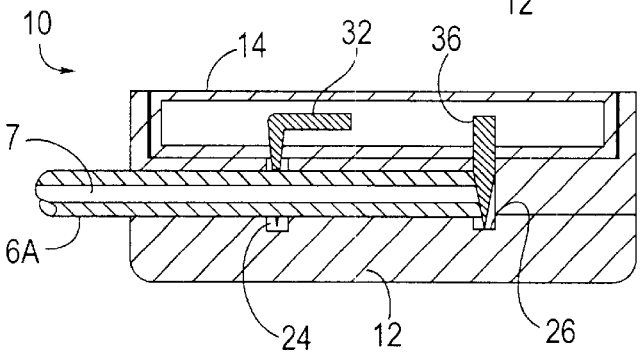
FIG. 8 is a cross-section of the subject wiring device taken along section line 8—8 of FIG. 6.

The cover member 14 supports a metal connector blade 32 as shown in FIG. 4, for example, having a notched or "V" shaped cutting end adapted to pierce the insulation of an electrical wire and to make an electrical connection to the wire conductor. The recess 24 formed in the base member 12 receives the distal end of the connector blade when the wiring device 10 is in the clamped position, with the dimensions of the blade and the recess being such that the blade will cut through the wire insulation and make electrical contact with the conductor without damaging the conductor. These dimensions must be selected to accommodate a particular wire gauge. Fortunately, wire sizes are somewhat standardized for various types of electrical fixtures so that one size wire device 10 can be used for servicing all fixtures of a particular type. FIG. 8 shows the connecting blade 32 engaging the conductor 7 of an electrical wire, with those portions of the insulation being pierced by the blade not being visible in this view.

As can best be seen in FIG. 4, the metal connector blade 32 has a cantilevered blade portion 32A at the end of the metal connector blade 32 opposite the notched cutting end. As will be explained, the cantilevered blade forms part of a connector 34, sometimes referred to as a poke-in connector, that operates to make an electrical connection to the conductor of a stripped wire. The metallic connector blade 32 and the cantilevered blade portion 32A are of unitary construction so as to form an electrical path between the two components.

A cutting blade 36 is also supported on tie cover member 14 and operates to sever a wire positioned along the wire path. A cutting blade recess 26 is formed in the base member 12 opposite the cutting blade 36 to receive the distal end of the blade. The recess 26 and blade 36 are dimensioned to ensure that the wire will be completely severed, as shown in FIG. 8 when the device is moved to the closed position.

Figure 9:
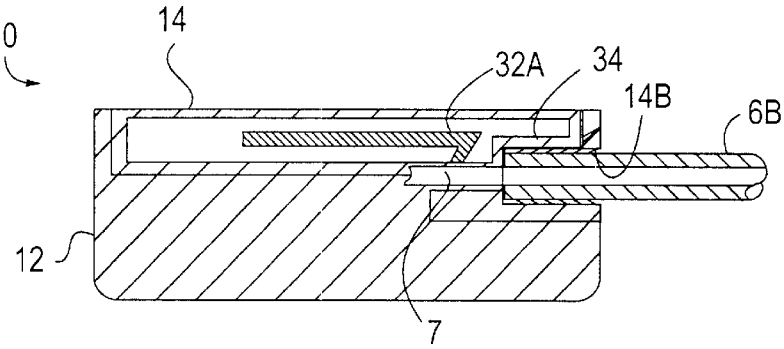
FIG. 9 is a cross-sectional view of the subject wiring device taken along section line 9—9 of FIG. 6.

The poke-in connector 34 (FIG. 2) is mounted on the cover member 14 for reconnecting the severed wires together after servicing has been completed. The connector 34 body is received by another recess 30 formed in the base member 14 when the wiring device is closed. The wire 6B, which is a dead section of the severed wire 6, if first stripped to expose the inner conductor 7 (FIG. 9). The wire end is then inserted into opening 14B of the cover member 14 (FIGS. 3 and 9) until the insulated portion is fully disposed within the housing. As can best be seen in FIG. 9, teeth are formed in the walls of connector 34 so as to grip the wire and hold the wire in place after insertion. The conductor 7, which is supported on one side by a portion of connector 34, will pass between the lower side of the connector and the connector blade 32A. The cantilevered blade portion 32A will be slightly deflected in the upward direction by the conductor 7 to permit the wire to pass. As can be seen in FIGS. 2 and 4, a slight notch (not designated) is formed in the end of blade portion 32A to help guide the conductor 7 during insertion. The blade portion 32A functions as a barb which will engage the conductor to both facilitate an electrical connection and to resist removal of the conductor once wire 6D has been inserted.

Figure 5:
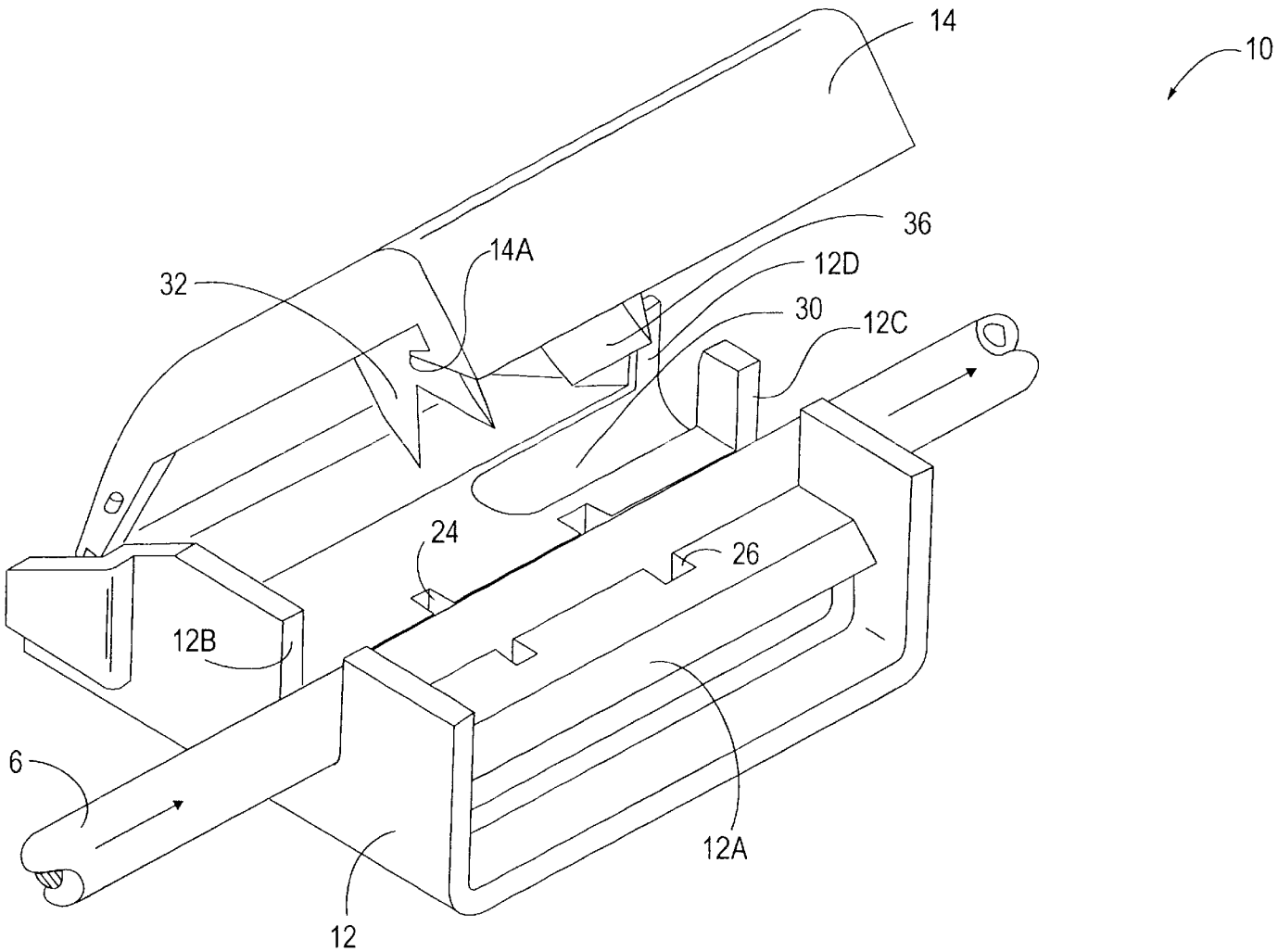
FIG. 5 is a front perspective view of the subject wiring device showing the hot wire in position prior to being severed.

The manner in which the subject wiring device 10 is used will now be described. Referring again to FIG. 1, a service person first cuts any secondary or neutral wires 3 near location 5 using insulated wire cutters. This operation is low risk since wire 3 is not at a high voltage. The service person then positions the open wiring device 10 over the live wire 6 as shown in FIG. 5, after having confirmed that the wire gauge is compatible with the wiring device. As can be seen in FIG. 4, the cover member 14 is preferably provided with printed or embossed indicia indicating the alignment of the device 10 relative to the power source 4 and the fixture to be serviced 2. The wiring device 10 is then moved to the clamping position, typically using a pliers-type tool which will provide sufficient force to sever wire 6.

Figure 3:
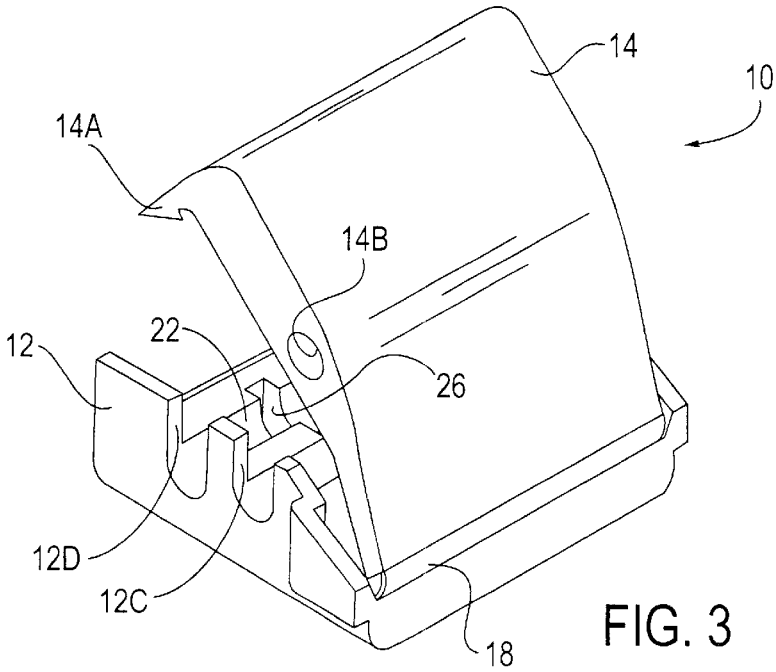
FIG. 3 is a rear perspective view of the subject wiring device showing the access opening in the housing for the poke-in connector.

At the same time that wire 6 is cut, connector blade 32 will make an electrical connection to the live wire section 6A of wire 6. Teeth 28 (FIG. 2) will engage the insulation of wire section 6A and resist removal of the wire section. The service person then withdraws the now-dead wire section 6B from device 10. The electrical fixture 2 can then be safely serviced. Once servicing has been completed, wire 3 is reconnected using a wire nut or the like. Next, the end of dead wire section 6B is stripped and then inserted into the poke-in connector 34 by way of access opening 14B as shown in FIGS. 3 and 10. This will complete the electrical connection between wire sections 6A and 6B thereby returning power to the fixture 2. Note that throughout the process, the service person is at no time exposed to any electrical hazard.

Thus, a novel wiring device and related method have been disclosed which greatly reduce the hazard of servicing electrical fixtures which are powered. Although one embodiment of the subject invention has been disclosed in some detail, it is to be understood that certain changes can be made by those skilled in the art without departing from the spirit and scope of the invention as defined by the appended claims. For example, the invention may be used with other wiring configurations. The cover and base members of the housing may be separate pieces which snap together to form the clamped housing.

What is claimed is:

1. A electrical wiring device including:

a housing including a first housing member and a second housing member, with the housing being movable between a clamped and an unclamped position and with the housing defining a wire path for receiving an insulated wire having outer insulation;

a contact blade mounted on the housing and movable between an open position displaced from the wire path when the housing is in the unclamped position and a contact position across the wire path when the housing is in the clamped position so that the contact blade will pierce the insulation and make electrical contact with a wire disposed along the wire path;

a cutting blade mounted on the housing and movable between an open position displaced from the wire path when the housing is in the unclamped position and a cutting position when the housing is in the clamped position so that the cutting blade will sever a wire disposed along the wire path; and an electrical contact mounted on the housing for receiving an end of an external electrical wire and configured to make an electrical connection between the external electrical wire and the contact blade.

2. The device of claim 1 wherein the first and second housing members are interconnected.

3. The device of claim 1 wherein the housing includes a hinge interconnecting the first and second housing members.

4. The device of claim 1 wherein the contact blade and the electrical contact are both mounted on the first housing member.

5. The device of claim 4 wherein the second housing member includes a first recess opposite the contact blade and along said wire path for receiving the contact blade when the contact blade is in the contact position.

6. The device of claim 5 wherein the cutting blade is mounted on one of the first and second housing members and a second recess is formed in another one of the first and second housing members opposite cutting blade along the wire path for receiving the cutting blade when the cutting blade is in the cutting position.

7. The device of claim 5 wherein the cutting blade is mounted on the first housing member and the second recess is formed in the second housing member.

8. The device of claim 1 further including a locking mechanism configured to lock the housing in the clamped position.

9. The device of claim 1 wherein the housing is fabricated from an electrical insulating material.

10. The device of claim 9 wherein the electrical contact is mounted within said housing to reduce electrical hazards.

11. The device of claim 9 wherein said housing includes a wire access opening for providing access to the electrical contact.

12. A method of servicing an electrical apparatus connected to a live electrical source by an insulated wire, said method comprising:

providing a wiring device movable between an open position and a closed position, said wiring device including first and second wire contacts electrically connected together and a wire cutting blade;

positioning the wiring device over the insulated wire with the wiring device in the open position;

moving the wiring device to the closed position so that the insulated wire is severed by the wire cutting blade to produce a dead wire section connected to the electrical apparatus and a live wire section connected to the electrical power source and so that the first wire contact pierces insulation of the live wire section to make electrical contact to the power source;

servicing the electrical apparatus; and inserting an end of the dead wire section into the second electrical contact thereby reconnecting the electrical apparatus to the power source.

13. A method according to claim 12 wherein prior to the inserting, insulation is removed from the dead wire section.

14. A wiring device for temporarily isolating an electrical apparatus from a live electrical circuit, said wiring device comprising:

an insulated housing;

cutting means supported on the housing for cutting a wire connecting the electrical apparatus to the live electrical circuit into a live wire portion and a dead wire portion;

first connecting means supported on the housing for making an electrical connection to the live portion; and second connecting means supported on the housing and electrically connected to the first connecting means for making an electrical connection to the dead wire portion so as to electrically connect the live wire portion and the dead wire portion.

15. The wiring device of claim 14 wherein the housing includes first and second housing members movable between an open position and a closed position.

16. The wiring device of claim 15 wherein the cutting means operates to cut the wire when the first and second housing members move from the open to the closed position.

17. The wiring device of claim 16 wherein the first connecting means operates to make an electrical connection to the live wire portion when the first and second housing members move from the open to the closed position.

18. The wiring device of claim 17 further including locking means for locking the housing in the closed position.

19. A wiring device for use with a wire having a conductor disposed within insulation comprising a housing of an electrical insulating material provided with a recess adapted to receive the wire, a cutting blade carried by the insulated housing for severing the wire in the recess into first and second wire portions, a first electrical contact carried by the housing for making electrical contact with the conductor of the first wire portion and a second electrical contact carried by the housing and electrically connected to the first electrical contact for making electrical contact with the conductor of the second wire portion whereby the conductors of the first and second wire portions can be electrically reconnected after being severed by the cutting blade.

20. The device of claim 19 wherein the housing includes first and second housing portions, the first housing portion being provided with the recess, the first and second housing portions being movable relative to each other between an open position and a closed position.

21. The device of claim 20 wherein the housing includes a hinge for interconnecting the first and second housing portions.

* * * * *